US009799317B2

(12) United States Patent
Winker

(10) Patent No.: US 9,799,317 B2
(45) Date of Patent: Oct. 24, 2017

(54) ACOUSTIC CHAMBER WITH LOW FREQUENCY TRANSPARENCY

(71) Applicant: ETS-Lindgren Inc., Cedar Park, TX (US)

(72) Inventor: Douglas Winker, Round Rock, TX (US)

(73) Assignee: ETS-Lindgren Inc., Cedar Park, TX (US)

( * ) Notice: Subject to any disclaimer, the term of this patent is extended or adjusted under 35 U.S.C. 154(b) by 0 days.

(21) Appl. No.: 15/093,092

(22) Filed: Apr. 7, 2016

(65) Prior Publication Data

US 2017/0200439 A1 Jul. 13, 2017

Related U.S. Application Data

(60) Provisional application No. 62/278,143, filed on Jan. 13, 2016.

(51) Int. Cl.
*G10K 11/16* (2006.01)

(52) U.S. Cl.
CPC ..... *G10K 11/16* (2013.01)

(58) Field of Classification Search
CPC ..... G10K 11/16
USPC ..... 181/198, 284, 286
See application file for complete search history.

(56) References Cited

U.S. PATENT DOCUMENTS 4,319,661 A * 3/1982 Proudfoot ..... G10K 11/172 181/286
4,347,912 A * 9/1982 Flocke ..... E04B 1/8409 181/286
5,744,763 A * 4/1998 Iwasa ..... B29C 43/203 181/286
6,158,176 A * 12/2000 Perdue ..... E04B 1/86 181/284
8,534,419 B2 * 9/2013 Coates ..... B32B 37/1284 181/284
8,820,476 B2 * 9/2014 Nam ..... E04B 2/7409 181/284
8,925,678 B2 * 1/2015 Tizzoni ..... E01F 8/0035 181/210

* cited by examiner

*Primary Examiner* — Forrest M Phillips
(74) *Attorney, Agent, or Firm* — Christopher & Weisberg, P.A.

(57) ABSTRACT

An acoustic chamber with low frequency outer wall transmissivity is provided. According to one aspect, an acoustic chamber has an inner wall encompassing an interior of the acoustic chamber and configured to allow acoustic energy to penetrate the inner wall. The acoustic chamber also has an outer wall configured to allow low frequency acoustic energy that penetrates the inner wall to penetrate the outer wall and leave the acoustic chamber.

17 Claims, 4 Drawing Sheets

ACOUSTIC CHAMBER WITH LOW FREQUENCY TRANSPARENCY

CROSS-REFERENCE TO RELATED APPLICATION

This application is related to and claims priority to U.S. Provisional Patent Application Ser. No. 62/278,143, filed Jan. 13, 2016, entitled "ACOUSTIC CHAMBER WITH LOW FREQUENCY TRANSPARENCY", the entirety of which is incorporated herein by reference.

TECHNICAL FIELD

The present disclosure relates to an acoustic chamber with low frequency outer wall transmissivity.

BACKGROUND

Anechoic and hemi-anechoic chambers are designed to mimic an acoustic free field inside of an enclosed environment. An acoustic free field is a region where there are no acoustically reflective surfaces or effects from such surfaces.

Current and historical anechoic chambers have all been constructed in similar methods. FIG. 1 is an acoustic chamber 10 having a solid outer wall 12 constructed to isolate the acoustic environment 14 inside the chamber from that outside the chamber. The outer wall 12 is typically constructed using modular steel panel systems or by conventional techniques such as concrete, cinder blocks, or studs and drywall. The interior of the outer wall 12 is then lined with an acoustic absorber system 16. The absorber system 16 absorbs nearly all of the acoustic energy within its frequency range of operation creating a free field. This absorber system 16 is typically a wedge or a tuned wedge/wall system where the wedges operate in conjunction with the wall panels. In a tuned wedge/wall system, the outer wall 12 of the chamber 10 is solid steel and the inner wall 20 is usually perforated steel. The inside of the wall enclosure 18 is filled with a variety of different materials depending on what the designer is trying to achieve.

In a tuned wedge/wall system, where the inner wall is perforated steel, the outer wall 12 of the acoustic chamber 10 in this case is solid and can be steel or one of the other materials mentioned above. The solid outer wall 12 is reflective and impacts the free field performance of the chamber below the absorber cutoff frequency. At low acoustic frequencies, the acoustic energy is not totally absorbed by the absorber system 16 and some acoustic energy passes through the perforated inner wall 20. Some of the acoustic energy passing through the inner wall 20 is absorbed by material of the wall enclosure 18. However, some of the acoustic energy will reflect from the inner surface of the solid outer wall 12 and will propagate back toward the interior 14 of the acoustic chamber 10. This is undesirable because it degrades the low frequency performance of the acoustic chamber 10.

In order to improve the low frequency performance of an anechoic chamber, conventional solutions call for the chamber size to increase and the depth of the absorber system 16 to increase. This greatly increases cost and size of these chambers and limits the ability of users to obtain a chamber that meets their low frequency requirements.

SUMMARY

The present embodiments advantageously provide an acoustic chamber with low frequency outer wall transmissivity. According to one aspect, an acoustic chamber has an inner wall encompassing an interior of the acoustic chamber and configured to allow acoustic energy to penetrate the inner wall. The acoustic chamber also has an outer wall configured to allow low frequency acoustic energy that penetrates the inner wall to penetrate the outer wall and leave the acoustic chamber.

According to this aspect, in some embodiments, the acoustic chamber further includes an interior absorber system lining the inner wall and configured to absorb acoustic energy above a particular frequency. In some embodiments, the outer wall is made of perforated metal. In some embodiments, the size and density of the perforations determine a frequency response of the outer wall. In some embodiments, the outer wall is made of a porous fabric. In some embodiments, the outer wall is made of a skeletal structure.

According to another aspect, a method of constructing an acoustic chamber is provided. The method includes constructing an inner wall configured to encompass an interior region of the acoustic chamber; the inner wall being at least partially acoustically penetrable. The method also includes constructing an outer wall in proximity to the inner wall, the outer wall being at least partially acoustically penetrable.

According to this aspect, in some embodiments, the method further includes installing acoustic absorbing material between the inner wall and the outer wall. In some embodiments, the acoustic penetrability of the outer wall is frequency-dependent. In some embodiments, the acoustic penetrability of the inner wall is frequency-dependent. In some embodiments, the method includes the inner wall facing the interior region with an acoustic absorbing material configured to absorb acoustic energy above a particular frequency. In some embodiments, the inner wall and lining material are configured to substantially absorb acoustic energy above a particular frequency. In some embodiments, the outer wall is configured to pass acoustic energy below the particular frequency. In some embodiments, the method further includes installing acoustic absorbing material between the inner wall and the outer wall. In some embodiments, a frequency response associated with the outer wall has a low pass component.

According to yet another aspect, a method of constructing a composite wall for an acoustic chamber is provided. The method includes constructing an inner wall having an acoustically penetrable surface. The method also includes constructing an outer wall having an acoustically penetrable surface, the outer wall being positioned in relation to the inner wall to form the composite wall.

According to this aspect, in some embodiments, the outer wall is substantially parallel to the inner wall. In some embodiments, the method further includes selecting a thickness of the composite wall to achieve a particular low pass frequency response of the composite wall.

BRIEF DESCRIPTION OF THE DRAWINGS

A more complete understanding of the present embodiments, and the attendant advantages and features thereof, will be more readily understood by reference to the following detailed description when considered in conjunction with the accompanying drawings wherein.

DETAILED DESCRIPTION

Figure 1:
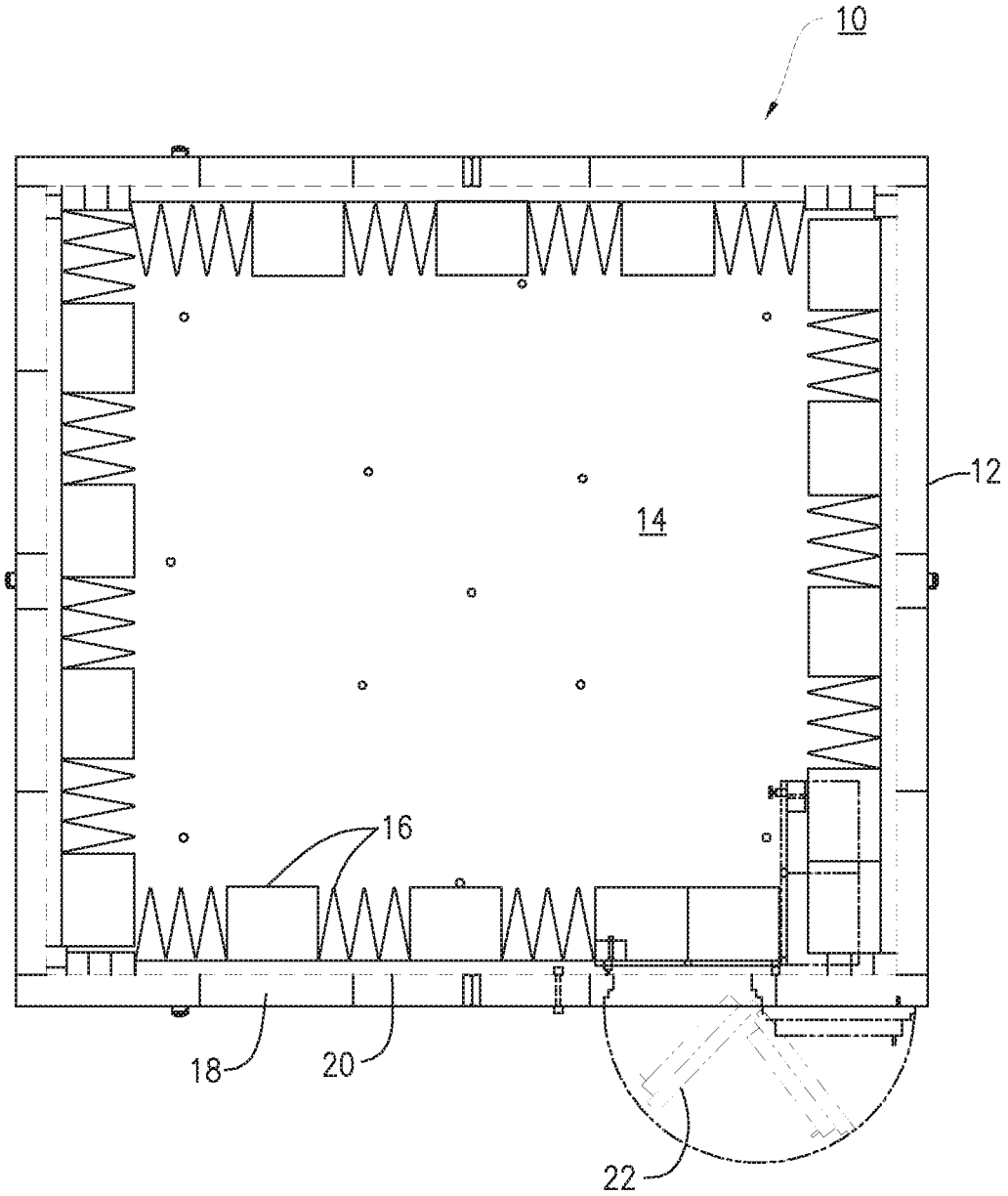
FIG. 1 is a cross sectional top view of a known acoustic chamber.
Figure 2:
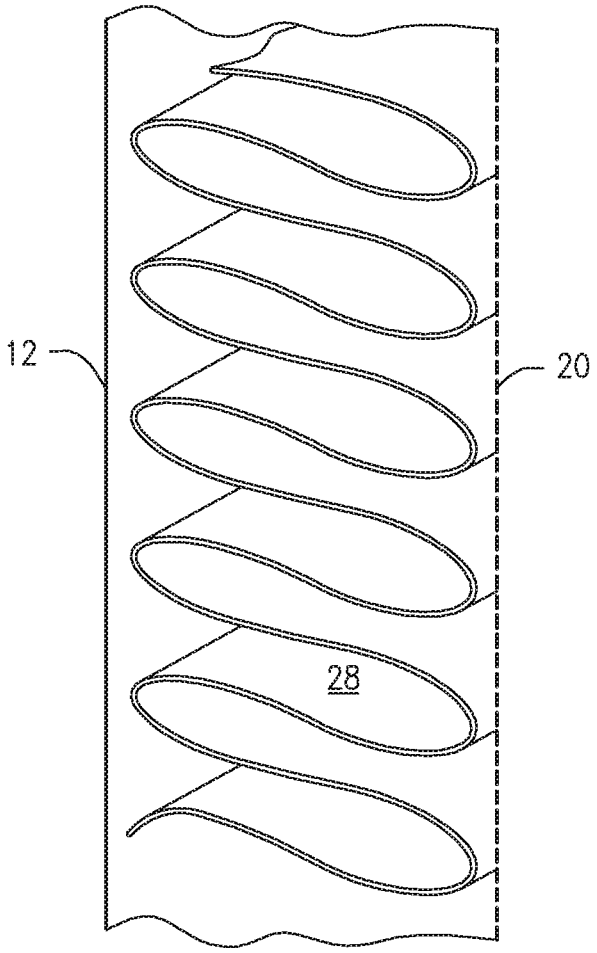
FIG. 2 is a cross sectional side view of a wall of a known acoustic chamber.

Before describing in detail exemplary embodiments, it is noted that the embodiments reside primarily in combinations of apparatus components and processing steps related to an acoustic chamber with low frequency transparency. Accordingly, components have been represented where appropriate by conventional symbols in the drawings, showing only those specific details that are pertinent to understanding the embodiments so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Conventional acoustic chambers have a solid outer surface. For example, the outer surface may be 16 gauge, 11 gauge or 3/16" thick solid steel. While providing enhanced isolation, the solid outer surface acts like an acoustically reflective surface below the cutoff frequency of the absorber system. This creates a low frequency limit to the performance of the anechoic chamber and influences the overall size of the chamber.

By changing the outer surface of the chamber to one that is more acoustically transparent through the use of a material such as perforated steel, the acoustically reflective outer surface is eliminated. Acoustic energy that is not absorbed by the absorber system is allowed to propagate through the absorber and outside of the enclosure. By allowing the energy to escape, the cut off frequency of the acoustic free field is lowered without increasing the size of the chamber or depth of the wedges.

Thus, in some embodiments, the outer surface of the acoustic chamber could be made of perforated steel of 16 gauge, 11 gauge or 3/16" thick. The density and/or size of the perforations can be chosen to achieve a desired frequency response. In alternative embodiments, the outer surface of the acoustic chamber can be fabric or other acoustically transparent material. In yet other embodiments, the outer surface of the acoustic chamber may be skeletal to provide support but leaving large open areas to be substantially acoustically transparent.

Figure 3:
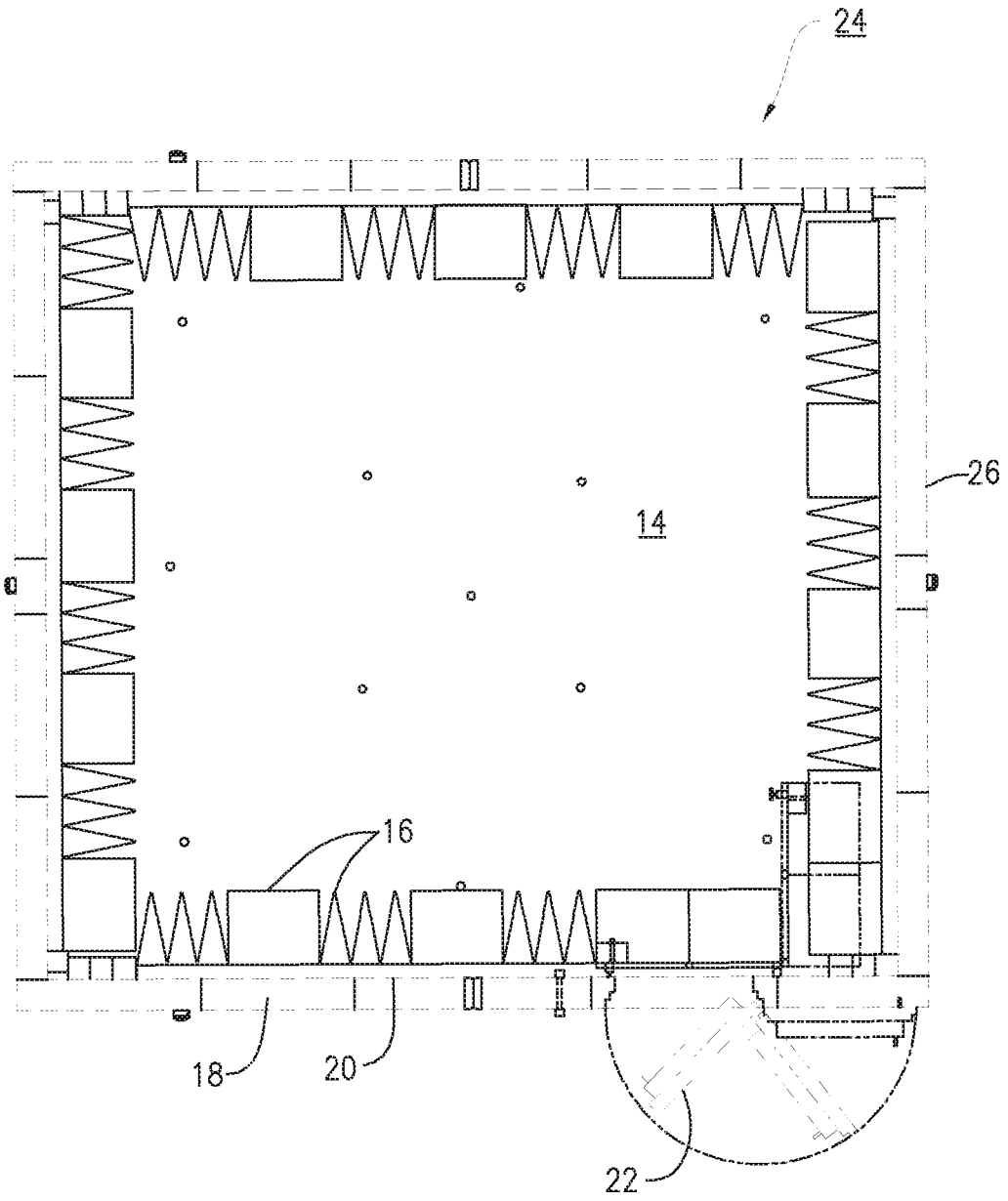
FIG. 3 is a cross sectional top view of an acoustic chamber having low frequency transparency.

FIG. 3 is an acoustic chamber 24 constructed according to principles discussed herein. The acoustic chamber 24 has an absorber system 16 in the interior 14 and lining the inner wall 20, which may be perforated steel, as described above. The acoustic chamber 24 has an outer wall 26 that allows low frequency acoustic energy to escape the acoustic chamber 24. This can be accomplished by constructing the outer wall 26 from perforated steel or by a flexible or rigid fabric, and/or a skeletal frame with openings.

Figure 4:
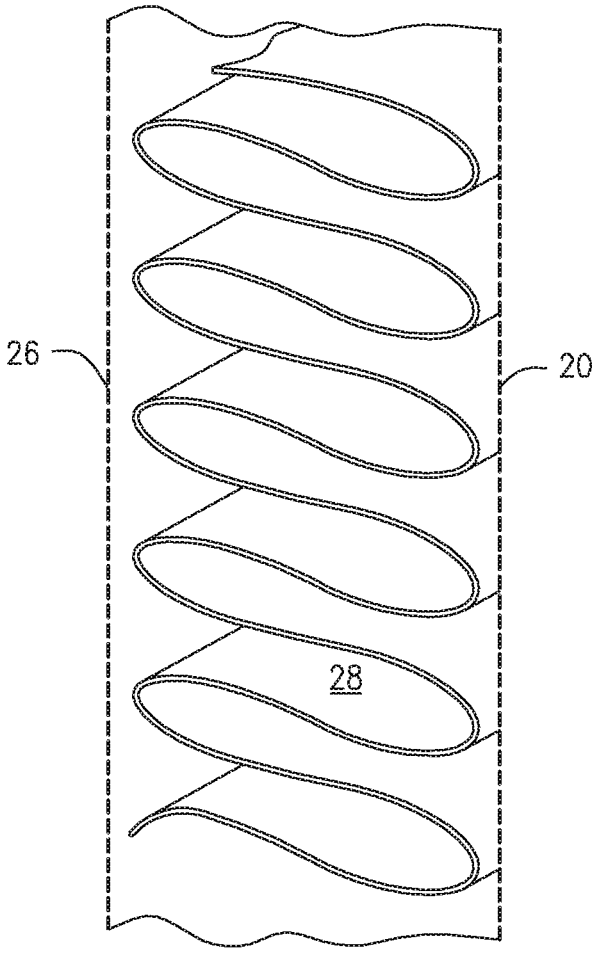
FIG. 4 is a cross sectional side view of a wall of an acoustic chamber having low frequency transparency.

FIG. 4 shows a cross sectional view of the wall formed by the inner wall 20 and outer wall 26 enclosing absorber material 28.

The absorber system 16 absorbs acoustic energy but may have a cutoff frequency below which acoustic energy is not effectively absorbed. Low frequency acoustic energy may propagate through the absorber system 16 and penetrate the inner wall 20 which may be made of perforated steel. Some of the acoustic energy is absorbed by the absorber 28 within the wall of the acoustic chamber. Acoustic energy that is not absorbed by the absorber 28 penetrates the outer wall 26 and propagates into the space surrounding the acoustic chamber 24.

Some embodiment include a method of constructing an acoustic chamber. The method includes constructing an inner wall configured to encompass an interior region of the acoustic chamber; the inner wall being at least partially acoustically penetrable. The method also includes constructing an outer wall in proximity to the inner wall, the outer wall being at least partially acoustically penetrable.

In some embodiments, the method further includes installing acoustic absorbing material between the inner wall and the outer wall. In some embodiments, the acoustic penetrability of the outer wall is frequency-dependent. In some embodiments, the acoustic penetrability of the inner wall is frequency-dependent. In some embodiments, the method includes the inner wall facing the interior region with an acoustic absorbing material configured to absorb acoustic energy above a particular frequency. In some embodiments, the inner wall and lining material are configured to substantially absorb acoustic energy above a particular frequency. In some embodiments, the outer wall is configured to pass acoustic energy below the particular frequency. The particular frequency can be adjusted as desired by adjusting the size and density of perforations in the inner wall and by adjusting a thickness and structure of the absorbing material lining the inner wall. In some embodiments, the method further includes installing acoustic absorbing material between the inner wall and the outer wall. In some embodiments, a frequency response associated with the outer wall has a high pass component.

Some embodiments include a method of constructing a composite wall for an acoustic chamber. The method includes constructing an inner wall having an acoustically penetrable surface. The method also includes constructing an outer wall having an acoustically penetrable surface, the outer wall being positioned in relation to the inner wall to form the composite wall. In some embodiments, the outer wall is substantially parallel to the inner wall. In some embodiments, the method further includes selecting a thickness of the composite wall to achieve a particular high pass frequency response of the composite wall. Generally, the thicker the composite wall—that is, the greater the distance between the inner and outer wall, when this thickness is filled with absorber—the lower the cutoff frequency of the composite wall, the cutoff frequency being the lowest frequency at which energy is substantially reflected by the wall.

It will be appreciated by persons skilled in the art that the present embodiments are not limited to what has been particularly shown and described herein above. In addition, unless mention was made above to the contrary, it should be noted that all of the accompanying drawings are not to scale. A variety of modifications and variations are possible in light of the above teachings without departing from the scope of the following claims.

What is claimed is:

1. An acoustic chamber, comprising:

an inner wall encompassing an interior of the acoustic chamber and configured to allow acoustic energy to penetrate the inner wall;

acoustic absorber lining an interior side of the inner wall at least in part and having a cutoff frequency below which acoustic energy is not effectively absorbed by the acoustic absorber; and a perforated outer wall in close proximity to the inner wall, the perforations configured to allow low frequency acoustic energy that penetrates the acoustic absorber and inner wall to penetrate the outer wall and leave the acoustic chamber, the perforated outer wall passing acoustic energy below the cutoff frequency of the acoustic absorber and blocking acoustic energy above the cutoff frequency;

the inner wall, the acoustic absorber and perforated outer wall forming a composite wall having a high pass reflectivity frequency response.

2. The acoustic chamber of claim 1, wherein the outer wall has a high pass reflectivity frequency response.

3. The acoustic chamber of claim 1, wherein a frequency response of the outer wall to pass acoustic energy below the cutoff frequency of the acoustic absorber and to block acoustic energy above the cutoff frequency of the acoustic absorber is adjusted by choice of at least one of the size and density of the perforations.

4. The acoustic chamber of claim 1, further configuring acoustic lining material between the inner wall and the outer wall, the lining material and the inner wall being configured to substantially absorb acoustic energy above the cutoff frequency of the absorber and to pass acoustic energy below the cutoff frequency of the absorber.

5. A method of constructing an acoustic chamber, the method comprising:

constructing an inner wall configured to encompass an interior region of the acoustic chamber; the inner wall being at least partially acoustically penetrable;

lining an interior side of the inner wall at least in part with acoustic absorber, the acoustic absorber having a cutoff frequency below which acoustic energy is not substantially absorbed and above which acoustic energy is substantially absorbed;

constructing a perforated outer wall in proximity to the inner wall, the outer wall passing acoustic energy below the cutoff frequency of the acoustic absorber and blocking acoustic energy above the cutoff frequency of the acoustic absorber;

the inner wall, the acoustic absorber and perforated outer wall forming a composite wall having a high pass reflectivity frequency response.

6. The method of claim 5, further comprising installing acoustic absorbing material between the inner wall and the outer wall.

7. The method of claim 5, wherein the acoustic penetrability of the outer wall is frequency-dependent.

8. The method of claim 5, wherein the acoustic penetrability of the inner wall is frequency-dependent.

9. The method of claim 5, wherein a reflectivity frequency response associated with the outer wall has a high pass component.

10. The method of claim 5, wherein the outer wall has a high pass reflectivity frequency response.

11. The method of claim 5, wherein a frequency response of the outer wall to pass acoustic energy below the cutoff frequency of the acoustic absorber and to block acoustic energy above the cutoff frequency of the acoustic absorber is adjusted by choice of at least one of the size and density of the perforations.

12. The method of claim 5, further configuring acoustic lining material between the inner wall and the outer wall, the lining material and the inner wall being configured to substantially absorb acoustic energy above the cutoff frequency of the absorber and to pass acoustic energy below the cutoff frequency of the absorber.

13. A method of constructing a composite wall for an acoustic chamber, the method comprising:

constructing an inner wall having an acoustically penetrable surface;

lining an interior side of the inner wall with acoustic absorber, the acoustic absorber having a cutoff frequency below which acoustic energy is not substantially absorbed by the acoustic absorber and above which acoustic energy is substantially absorbed by the acoustic absorber; and constructing a perforated outer wall in proximity to the inner wall and having a surface that is acoustically penetrable below the cutoff frequency of the acoustic absorber and acoustically impenetrable above the cutoff frequency of the acoustic absorber, the inner wall, the acoustic absorber and perforated outer wall forming a composite wall having a high pass reflectivity frequency response.

14. The method of claim 13, wherein the outer wall is substantially parallel to the inner wall.

15. The method of claim 13, wherein the outer wall has a high pass reflectivity frequency response.

16. The method of claim 13, wherein a frequency response of the outer wall to pass acoustic energy below the cutoff frequency of the acoustic absorber and to block acoustic energy above the cutoff frequency of the acoustic absorber is adjusted by choice of at least one of the size and density of the perforations.

17. The method of claim 13, further configuring acoustic lining material between the inner wall and the outer wall, the lining material and the inner wall being configured to substantially absorb acoustic energy above the cutoff frequency of the absorber and to pass acoustic energy below the cutoff frequency of the absorber.

* * * * *